US005100563A

United States Patent [19]

Suzuki

[11] Patent Number: 5,100,563

[45] Date of Patent: Mar. 31, 1992

[54] METHOD FOR INTRODUCING PURE HOT-SPRING WATER DIRECTLY TRANSPORTED FROM A SPA INTO A SPA HOUSE BATH AND FOR MAINTAINING THE PURITY AND FRESHNESS OF THE INTRODUCED WATER

[76] Inventor: Hirotsugu Suzuki, 514, Nougayamachi, Machida-shi, Tokyo, Japan

[21] Appl. No.: 646,058

[22] Filed: Jan. 25, 1991

[51] Int. Cl.[5] ..... B67D 5/02

[52] U.S. Cl. ..... 210/747; 210/169; 210/196; 210/774; 210/805; 210/181; 405/53; 141/231

[58] Field of Search ..... 210/167, 169, 747, 194, 210/196, 774, 805, 181; 405/52, 53; 141/86, 98, 231

[56] References Cited

U.S. PATENT DOCUMENTS

| | | | |
|---|---|---|---|
| 2,928,436 | 3/1960 | Wendrow et al. | 141/231 |
| 3,943,580 | 3/1976 | Carter | 210/169 |
| 4,945,908 | 8/1990 | Schneider | 210/169 |
| 4,986,696 | 1/1991 | Pera et al. | 405/52 |
| 5,032,292 | 7/1991 | Conrad | 210/169 |

FOREIGN PATENT DOCUMENTS

| | | | |
|---|---|---|---|
| 139399 | 5/1990 | Japan | 141/231 |

*Primary Examiner*—Stanley S. Silverman
*Assistant Examiner*—Neil M. McCarthy
*Attorney, Agent, or Firm*—Price, Heneveld, Cooper, DeWitt & Litton

[57] ABSTRACT

A method for introducing pure hot-spring water directly transported from a spa into baths of a spa house and for maintaining the purity and the freshness of the introduced water. Pure hot-spring water directly transported from a spa by a transportation means is supplied into an underground reservoir. The supplied water is pumped by means of a primary pump, then warmed to a certain temperature by means of a first heat exchanger utilizing warm circulating water warmed by a boiler. The warmed hot-spring water is stored in a storage tank. When the water level in a hot-spring water bath has lowered, hot-spring water is pumped from the storage tank into the bath by means of a secondary pump. When the hot-spring water in the bath is contaminated, the hot-spring water is circulated in such a manner that the water is first passed through a filter for hot-spring water to have the contamination contained therein removed, then returned to the bath. The water being circulated is warmed by a second heat exchanger utilizing warm water when, during the circulation, the temperature of the water has decreased.

1 Claim, 1 Drawing Sheet

METHOD FOR INTRODUCING PURE HOT-SPRING WATER DIRECTLY TRANSPORTED FROM A SPA INTO A SPA HOUSE BATH AND FOR MAINTAINING THE PURITY AND FRESHNESS OF THE INTRODUCED WATER

BACKGROUND OF THE INVENTION

The present invention relates to the use of pure and fresh hot-spring water directly from a spa in facilities such as health and recuperation centers equipped with baths, resting rooms, medical treatment rooms, restaurants, lounges, etc.

Centers of the above-described nature are located in, for instance, metropolitan suburbs. Such conventional centers have baths which are either baths utilizing mineral-spring waters or baths containing chemical substances. However, none of the baths in the conventional centers utilize pure and fresh hot-spring waters which have been transported from spas or watering places. This often means that when one wants to take a real hot-spring cure, one has to visit a spa. If one is leading a busy life in a city remote from a spa, taking a balneotherapy in a spa can be a rare opportunity because of the time and expense required.

SUMMARY OF THE INVENTION

The present invention has been accomplished in view of affording opportunities of taking balneotherapy to those who cannot easily afford to visit a spa for this purpose because, for instance, he lives in a distant place or has not enough time.

Specifically, the present invention is intended to maintain the purity and freshness of hot-spring water directly transported from a spa so that a person can take a balneotherapy without visiting a spa.

In order to achieve the above objects, the present invention provides a method for introducing pure hot-spring water directly transported from a spa into baths of a spa house and for maintaining the purity and the freshness of the introduced water, comprising the steps of: supplying pure hot-spring water directly transported from a spa by a transportation means into an underground reservoir; pumping, by means of a primary pump, the hot-spring water supplied into the underground reservoir; warming, by means of a first heat exchanger, the hot-spring water pumped by the first pump to a certain temperature, the first heat exchanger utilizing warm circulating water warmed by a boiler; storing the pure hot-spring water warmed into a storage tank; pumping, by means of a secondary pump, hot-spring water from the storage tank into a hot-spring water bath when the water level in the bath has lowered; and, when the hot-spring water in the bath is contaminated, causing the hot-spring water to circulate in such a manner that the water is first passed through a filter for hot-spring water so that the contamination contained in the water is removed, then returned to the bath, the water being circulated is warmed by a second heat exchanger utilizing warm water when, during the circulation, the temperature of the water has decreased.

The term "spa house" used here means a health and recuperation center whose main feature is baths utilizing hot-spring water (water originating from a hot spring) directly transported from a spa by a transportation means, the center further including restaurants, resting rooms, medial treatment rooms, lounges.

The above-specified method enables hot-spring water directly transported from a spa to be introduced into a bath of a spa house, i.e., a hot-spring water bath, and enables the purity and the freshness of the hot-spring water introduced to be maintained.

BRIEF DESCRIPTION OF THE DRAWING

The single drawing illustrates a system for carrying out an embodiment of the present invention.

DESCRIPTION OF THE PREFERRED EMBODIMENT

Figure 1:
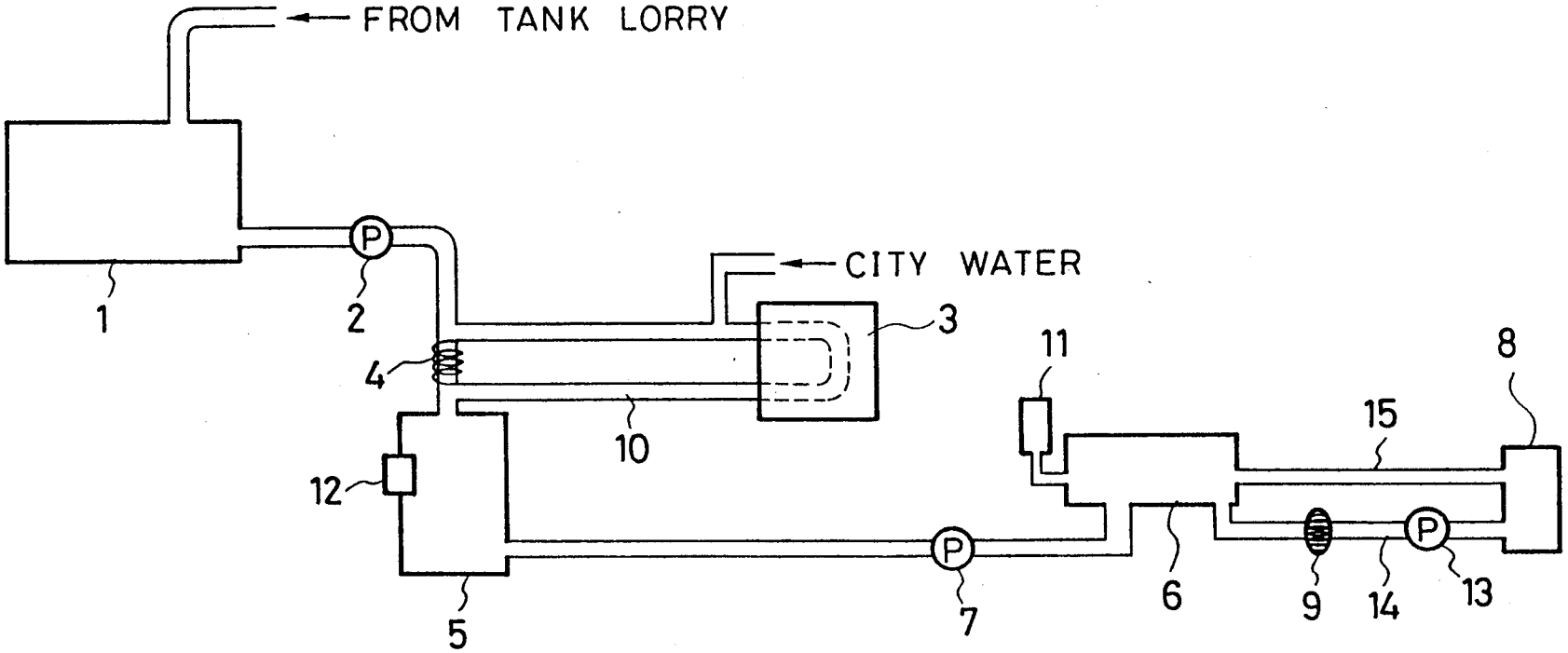

The preferred embodiment of the present invention will now be described with reference to the drawing.

Pure hot-spring water is directly transported from a spa by a transportation means, such as a tank lorry, to a spa house, and it is then supplied into an underground reservoir 1.

The hot-spring water supplied into the underground reservoir 1 is pumped by a primary pump 2. Since the hot-spring water supplied into the underground reservoir 1 is at a temperature of about 40° C., the temperature of the hot-spring water is increased by warming the water by means of a first heat exchanger 4 utilizing warm circulating water which has been warmed by a boiler 3 and which circulates through a pipe 10. A temperature suitable as the temperature to which that of the hot-spring water is increased is 45° C. or thereabout. City water is suitable as the warm circulating water. Then, the hot-spring water warmed is stored in a storage tank 5.

Since the hot-spring water is warmed by the warm circulating water, the purity of the hot-spring water can be maintained without changing the chemical composition of the hot-spring water.

When a hot-spring water bath 6 contains no hot-spring water or when the level of the water contained in the hot-spring water bath 6 has lowered, a suitable amount of the hot-spring water stored in the storage tank 5 is pumped into the hot-spring water bath 6 by a secondary pump 7. For this purpose, the hot-spring water bath 6 has a water level gauge 11, while the storage tank 5 has a pressure gauge 12.

When the hot-spring water in the hot-spring water bath 6 is contaminated, the hot-spring water is sent, by means of another pump 13, through a pipe 14 into a filter 8 for hot-spring water so that the contamination contained in the water will be removed by the filter 8. After removal, the resultant hot-spring water is returned through a pipe 15 to the bath 6.

When the temperature of the hot-spring water has decreased, this temperature is increased by a second heat exchanger 9 which is disposed in the pipe 14 and utilizes warm water.

Thus, the hot-spring water in the bath 6 is circulated, whenever required, through the circuit including the pump 13, the filter 8 and the heat exchanger 9, so as to maintain the freshness as well as the purity of the hot-spring water.

With the method according to the present invention, hot-spring water is directly transported from a spa to a place which may be far from the spa, thereby enabling people to take balneotherapy where the spring water has been transported.

Some of the most important requirements of water used in balneotherapy are that it be hot-spring water originating from a hot spring and that the water used be always as pure and fresh as it was when transported.

According to the present invention, the hot-spring water, originating from a hot spring, can be maintained at its initial purity and freshness. In addition, when the temperature of the hot-spring water has decreased, this temperature is increased by a heat exchanger utilizing warm water, that is, while preventing the components of the hot spring from being changed or destroyed.

As described above, according to the present invention, balneotherapy is available for people even when they live in places remote from spas or when they can hardly find time to visit a spa.

What is claimed is:

1. A method for introducing pure hot-spring water directly transported from a spa into baths of a spa house and for maintaining the purity and the freshness of the introduced water, comprising the steps of:

supplying pure hot-spring water directly transported from a spa by a transportation means into an underground reservoir;

pumping, by means of a primary pump, the hot-spring water supplied into said underground reservoir;

warming, by means of a first heat exchanger, the hot-spring water pumped by said primary pump to a certain temperature, said first heat exchanger utilizing warm circulating water warmed by a boiler;

storing the pure hot-spring water warmed into a storage tank;

pumping, by means of a secondary pump, hot-spring water from said storage tank into a hot-spring water bath when the water level in said bath has lowered; and when the hot-spring water in said bath is contaminated, causing said hot-spring water to circulate in such a manner that said water is first passed through a filter for hot-spring water so that the contamination contained in said water is removed, then returned to said bath, said water being circulated is warmed by a second heat exchanger utilizing warm water when, during the circulation, the temperature of said water had decreased.

* * * * *